United States Patent [19]

Arnold et al.

[11] Patent Number: 4,854,383

[45] Date of Patent: Aug. 8, 1989

[54] MANIFOLD ARRANGEMENT FOR USE WITH A TOP DRIVE POWER UNIT

[75] Inventors: Ronald D. Arnold, Missouri City, Tex.; Gerald R. Atol, Eagle River, Ak.; Samuel F. Baker, Conroe, Tex.

[73] Assignee: Texas Iron Works, Inc., Houston, Tex.

[21] Appl. No.: 249,838

[22] Filed: Sep. 27, 1988

[51] Int. Cl.[4] ..... E21B 33/05; E21B 33/13

[52] U.S. Cl. ..... 166/70; 166/95; 166/153; 166/291

[58] Field of Search ..... 166/70, 95, 153, 154, 166/192, 291; 175/207

[56] References Cited

U.S. PATENT DOCUMENTS

| | | | |
|---|---|---|---|
| Re. 21,677 | 12/1940 | Tremolada | 175/216 |
| 3,076,509 | 2/1963 | Burns et al. | 166/70 |
| 3,216,500 | 11/1965 | Diehl | 166/70 |
| 3,479,829 | 11/1969 | Goodman | 166/285 |
| 3,720,264 | 3/1973 | Hutchison | 166/311 |
| 3,750,749 | 8/1973 | Giroux | 166/95 |
| 3,828,852 | 8/1974 | Delano | 166/70 |
| 3,971,436 | 7/1976 | Lee | 166/70 |
| 4,246,967 | 1/1981 | Harris | 166/291 |
| 4,266,620 | 5/1981 | Walgommot et al. | 175/215 |
| 4,427,065 | 1/1984 | Watson | 166/70 |
| 4,520,879 | 6/1985 | MacElvain | 173/57 |
| 4,674,573 | 6/1987 | Bode | 166/291 |
| 4,722,389 | 2/1988 | Arnold | 166/70 |

OTHER PUBLICATIONS

International Publication No. WO80/02717 (Inventor: Wallgren, Alf; International Application No. PCT/SF 80/00158; International Filing Data May 30, 1980).

Composite Catalog of Oil Field Equipment & Services, Bowen, p. 730, vol. 1, 1962–62.

*Primary Examiner*—Jerome W. Masie, IV
*Assistant Examiner*—Terry Lee Melius
*Attorney, Agent, or Firm*—Jack W. Hayden

[57] ABSTRACT

A manifold arrangement for use with a top drive power unit to enable fluid circulation to be conducted to a well string for well bore conditioning to be effected with cementing plugs in place in the manifold arrangement and for conducting a pumpable substance such as cement to the well string without first circulating it through the top drive power unit.

2 Claims, 2 Drawing Sheets

FIG. 1
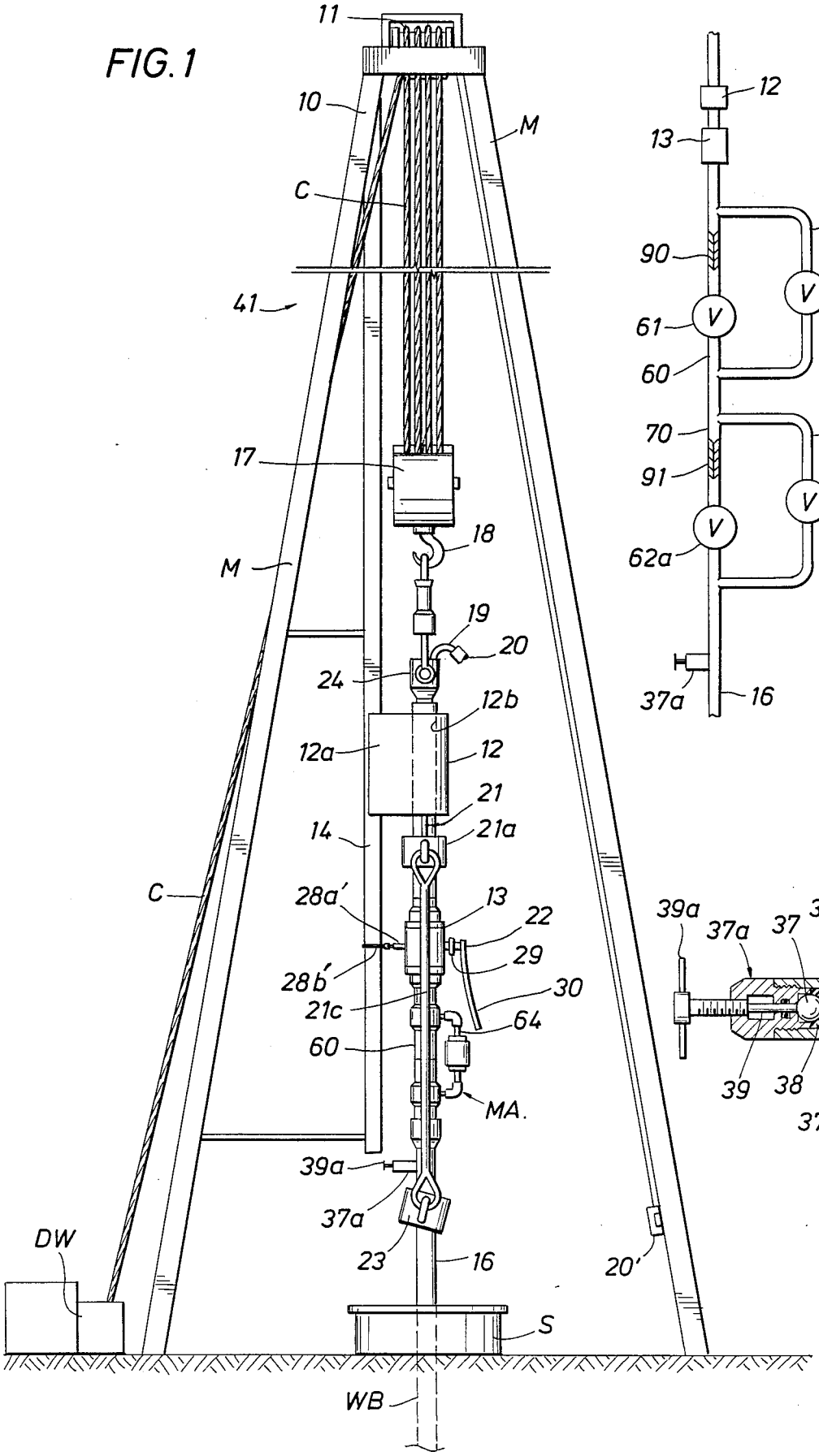
FIG. 2
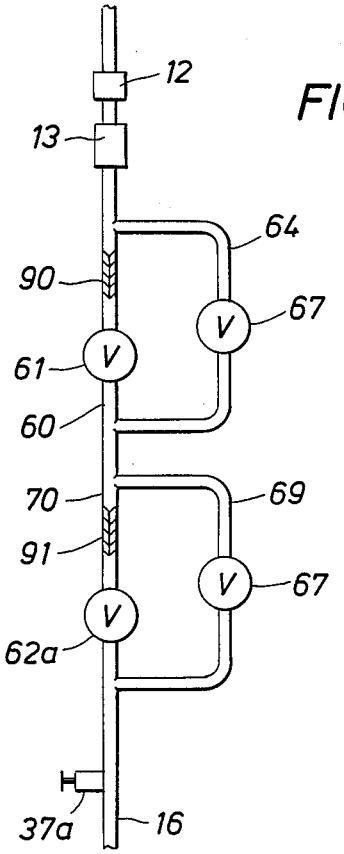
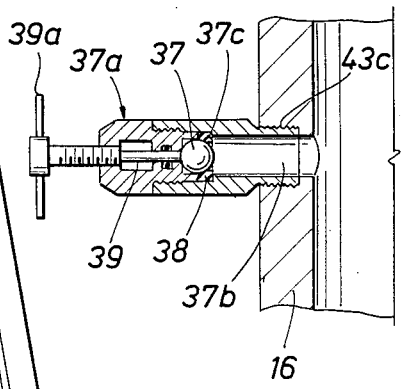
FIG. 2A

FIG. 3
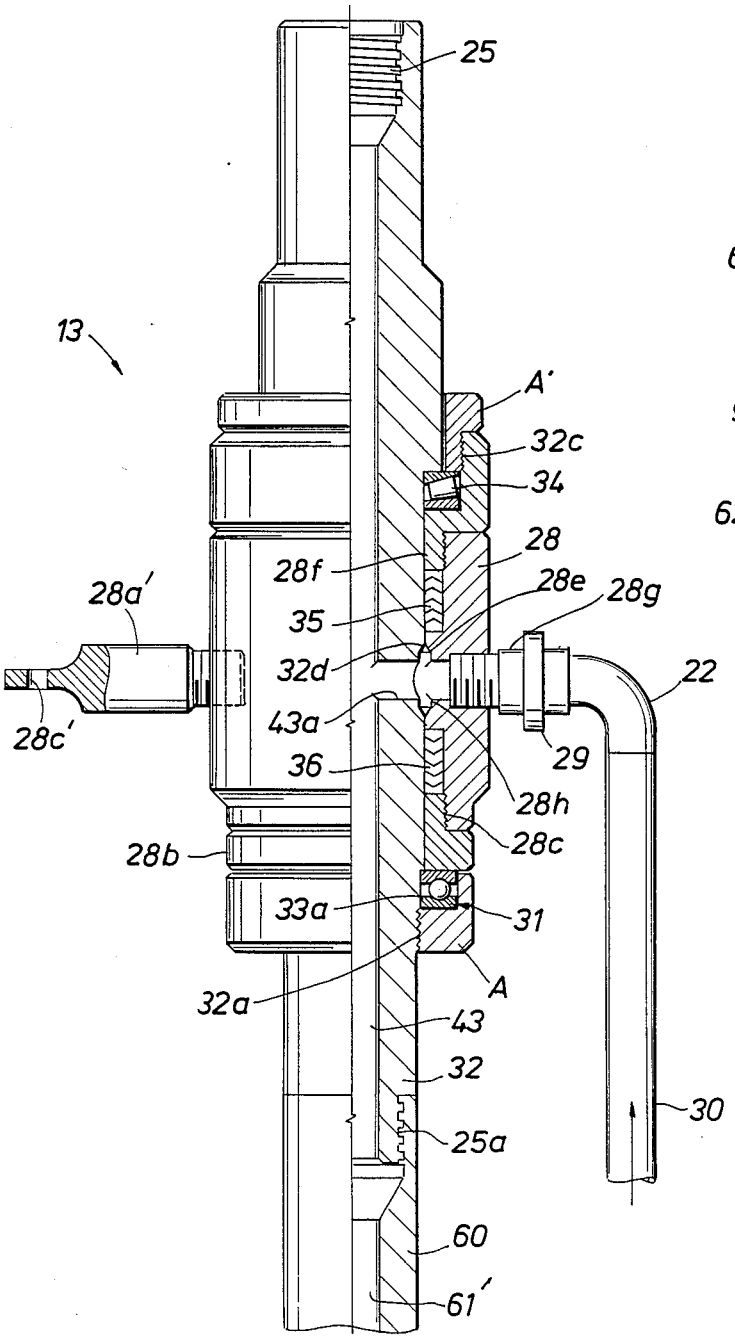
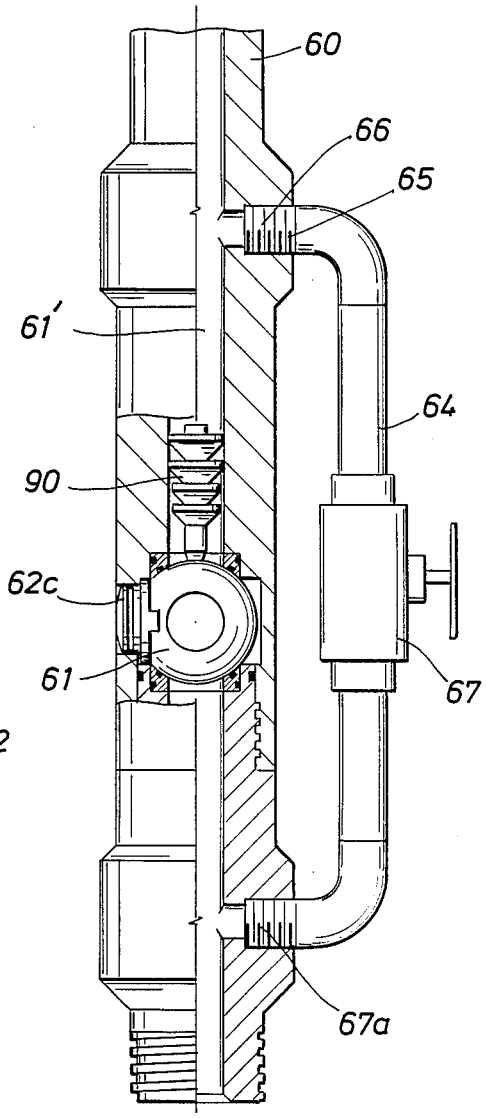
FIG. 4

MANIFOLD ARRANGEMENT FOR USE WITH A TOP DRIVE POWER UNIT

DESCRIPTION OF THE PRIOR ART

The closest prior art with which applicant is familiar is U.S. Pat. No. 4,722,389 issued to applicant of the present invention and U.S. Pat. No. 3,828,852 issued on Aug. 13, 1974.

U.S. Pat. No. 4,722,389 discloses an arrangement for connecting with rotatable hollow stem of a top drive power unit so that a pumpable substance such as cement or the like may be conducted to the well string without discharging it though the top drive power unit.

U.S. Pat. No. 3,828,852 discloses a manifold arrangement for discharging cement into the wall string while it is simultaneously rotated and reciprocated.

The present invention differs from the above prior art in that it provides an arrangement whereby circulation of well fluids from the earth's surface through a top drive power unit and into a well string in a well bore may be effected while pump down cementing plugs are positioned in place so that fluid circulation may be interrupted and cement discharged into the manifold arrangement from a separate inlet so that the cement does not flow through the top drive unit, and the cement displaces the pump down plug means in a desired manner to effect cementing operations. All of the foregoing may be accomplished while the well string is both rotated and reciprocated.

Other objects and advantages of the present invention will become apparent from consideration of the following drawings and description.

BRIEF DESCRIPTION OF THE DRAWINGS

FIG. 1 is an illustration of a mast with a top drive unit mounted therein and one form of the manifold arrangement of the present invention;

FIG. 2 is a schematic illustration of an alternate embodiment of the manifold arrangement;

FIG. 2A is a partial sectional view of a ball support and dropping means;

FIG. 3 is a sectional view of a portion of the manifold arrangement for conducting cement to the well string without first going through the top drive unit; and FIG. 4 is a sectional view partly in elevation illustrating in greater detail the form of the manifold arrangement shown in FIG. 1.

DESCRIPTION OF THE PREFERRED EMBODIMENTS

Attention is first directed to FIG. 1 wherein a mast assembly is referred to generally by the numeral 41 and includes suitable longitudinally extending members M supported on the earth's surface adjacent the well bore WB in the earth's surface. A well string 16 is shown as extending into the well bore, which well string 16 is connected at its upper end to the lower end of a feeder 13 as will be described. The member S at the top of the well bore provides a support for use during "tripping" the pipe, or well spring. Schematically illustrated at 11 is a crown block which includes a plurality of rotatable pulleys. As is well known to those skilled in the art, suitable cable means C extends from a draw works drum DW powerred by a draw works which extends up over the pulleys in the crown block 11 and down to what is termed the travelling block 17. The cable C extends back and forth between the pulleys in the crown block 11 and travelling block 17, with one end of the cable secured to a portion of the mast 10 or a suitable anchor represented at 20'.

Laterally spaced, longitudinally extending, preferably vertical, guide rails 14 are supported by the mast 10 and extend longitudinally adjacent the well bore WS which receives the well string 16 as disgramatically represented in FIG. 1. A suitable frame **12*a* is provided for movement along the spaced guide rails 14, such frame having secured therewith the swivel 24 which is suspended from the hook 18 that in turn is rotatably supported by the travelling block 17. The swivel 24 is provided with a gooseneck 19 for connection with a drilling fluid line 20 whereby drilling fluid may be supplied from an external source to the swivel for discharge through the rotatable stem 12b of the top drive power unit schematically represented at 12 which is supported by the frame 12*a* for movement along the guide rails 14. A suitable power source, the details of which are not illustrated, are also supported on the frame 12*a* for imparting rotation of the rotatable tubular member or hollow stem 12*b* of the top drive power unit, which stem is connected at its upper end with a rotatable tubular member that depends from the swivel 24 and the hollow stem 12*b* is connected to communicate at its lower end directly to the upper end of the inner member 32 of the feeder 13. The inner member 32 of feeder 13 is connected at its lower end of the manifold arrangement of the present invention designated generally at MA. The lower end of the manifold arrangement is connected to the upper end of well string 16**.

Also suspended from the frame **12*a* is a pair of diametically opposed support members 21 depending from the power unit 12 and having a generally circular member 21*a* at their lower end on which are pivotally supported links 21*c*. The links 21*c* are pivotally connected at their lower ends with the elevator 23 as illustrated in FIG. 1 of the drawings. The elevator is employed when the well string is being "tripped", that is when it is being lowered into the well bore joint by joint, or removed from the well bore by disconnecting one or more joints at a time from the well string. Otherwise, while conducting normal drilling operations or well servicing operations, the elevator 23 merely hangs alongside the well string 16, as shown so as to not interfere with rotation thereof, or longitudinal movement along with power unit 12. The structure of the power unit 12** and the arrangement of the various components associated therewith are well known to those skilled in the art.

The pumpable substance feeder 13 for conveying pumpable substance such as cement slurry from an external supply source to the top of the well string 16 while bypassing the top drive power unit 12 is shown at 13 in FIG. 1 and in greater detail in FIG. 3. The feeder means 13 includes a inner tubular member or mandrel 32 which extends longitudinally through outer tubular member or housing 28. The mandrel 32 is provided with a longitudinally extending passageway 43 therethrough which communicates with at least one intersecting lateral flow passage means **43*a* through said inner tubular member intermediate the ends of said longitudinal flow passage. More particularly, the lateral flow passage means 43*a* is shown in FIG. 3 as being positioned in the inner tubular member intermediate the ends of the outer tubular member 28**.

The outer housing 28 is positioned relative to the inner tubular member 32 for sealable and relative rotation therebetween. The positioning means includes a lower support or cap A which is secured to the inner tubular member 32 by any suitable means such as the threads 32*a*. A ball bearing arrangement 31 includes the race 33*a* supported in the cap A to accommodate axial thrust loads encountered by the feed means 13 and its retained by the lower ring 28*b* supported on the outer housing 28 by any suitable means such as the threads 28*c* as shown. A tapered roller bearing race 34 is provided adjacent the other end of the outer housing 28 as shown and is retained in position by means of the upper cap A' engaging with housing 28 by any suitable means such as threads 32*c* as shown to carry lateral or side thrust loads.

The seal means 35 and 36 between the inner tubular member 32 and the outer housing 28 is positioned so as to be on each side of, or to span the lateral flow passage means 43*a*. Also, a circumferencial groove as shown at 32*d* may be formed on the outer periphery or surface of the inner tubular member 32 and a mating groove 28*e* can be formed on the inner surface of the outer housing 28 to better accommodate continuous fluid flow from an external source of the pumpable substance to the longitudinal passage 43 in the inner tubular member 32. The upper end of ring 28*b* serves as a retainer for the lower seal means 36 and a suitable retainer ring 28*f* may be engaged by threads as shown in the outer housing 28 for retaining the seal menas 35 in position and to assist in supporting.

It can be appreciated that suitable shoulders are provided in the outer housing 28 on which the seal means 35 and 36 are seated as shown.

An inlet conduit 30 is provided for connection with an external supply source for receiving the pumpable substance therethrough to discharge it through connection 22 and a "WECO" wing fastener 29 which secures the pipe or conduit 30 to the connection 28*g* that is threadedly secured in the lateral passage 28*h* of outer member 28 that communicates with groove 28*e*, groove 32 and the lateral passage means 43*a* in the inner tubular member.

The feeder means 13 is connected by suitable means such as threaded connection 25 to the lower end of the hollow stem 12*b* of the top drive power unit 12 whereby rotation and longitudinal movement may be transmitted from the top drive power unit through the feeder means 13 and manifold arrangement MA to the well string 16 connected therewith while the pumpable substance is discharged to the moving well string 16 without first passing the substance through the top drive unit 12.

Suitable threads 25 at the upper end of the longitudinal passage 43 are provided for connection with the lower end of the hollow, rotatable stem 12*b* of the top drive power unit 12. Thus, the feeder 13 forming part of the manifold arrangement of the present invention communicates longitudinally and directly with the hollow, rotatable stem 12*b* of the top drive power unit for discharge of well bore circulating fluid through the rotatable unit and the remainder of the manifold arrangement as will be described.

The member 28*a*' projects laterally from outer housing 28 and suitable means such as a cable 28*b*' may be inserted in opening 28*c*' and looped around one of the rails 14 to restrain rotation of housing 28 while accommodating movement along rail 14.

Threaded means 25*a* are provided adjacent the lower end of the inner tubular member 32 as shown in FIG. 3 for connecting with hte upper end of the first connection means 60 of the manifold arrangement MA. The first connection means is in the form of a longitudinally extending conduit with a longitudinal passage 61' extending therethrough as better shown in FIG. 4 of the drawings.

Suitable valve means such as the ball valve 61 is sealably and suitable mounted in the first connection passage means 61' as shown in FIG. 4 for controlling communication through the first connection means 60. When the valve means 61 is in the closed position as shown in FIG. 4, communication through the first connection means is closed off and the first valve means 61 can serve as a support means for hte plug meansb 90 used in cementing operations.

Second connection means 64 are connected with the first connection means as shown in FIG. 4 of the drawings. Such connection means 64 constitutes a conduit with a passageway 65 therethrough. The upper end 66 of the passageway intersects the longitudinal passage 61' of the first connection means 60 above the vavle means 61 and the lower end 67*a* of the passageway intersects the passageway 61' below the valve means 61 as shown.

A suitable valve such as a ball valve 67 is mounted in the conduit of the second connection 64 for controlling communication through passage 65 as will be explained in greater detail.

In FIG. 2 the manifold arrangement of the present invention is shown as including upper and lower first connection means 60 and 70 each having a conduit with longitudinal passage means therethrough and which are threadedly connected together. The well string 16 is in turn threadedly connected to the lower end of the lower first connection means 70 as schematically illustrated in FIG. 2 of the drawings.

Similarly, FIG. 2 illustrates the alternate manifold arrangement shown therein as including upper and lower longitudinally spaced second connection means 64 and 69. The lower second connection means 69 is similar in construction to the upper second connection means 64 as previously described hereinabove and has its upper end intersecting the longitudinal passage through the lower first connection means above a ball valve 62*a* arranged in the longitudinal passage of the lower first connection means and the lower end of the lower second connection means intersects the longitudinal passage through the lower first connection means below the ball valve means 62*a* as shown. The lower second connection means also includes valve means 67 to control flow therethrough.

When the ball valve means 62*a* of the lower first connection means is closed, a pump down plug means 91 may be supported thereon.

Where it is desired to hydraulically set a liner in a well bore, the housing means 37*a* may be connected with the lower first connection means 69 to intersect the longitudinal passage therethrough.

FIG. 2A is an enlargement of the housing means 37*a* and its relationship to the longitudinal passage extending through either the lower first connections means 70 when the FIG. 2 form is employed, or where only the upper first and second connection means 60 and 64 is employed as illustrated in FIG. 1. The housing 37*a* is mounted to communicate with the passage 61' as illustrated in FIG. 1 where the upper and lower first connection means are employed, and the housing 37*a* communicates with the longitudinal passage 61' through the lower first connection means as shown in FIG. 2.

An additional lateral passage 43*c* is provided in the inner tubular member for receiving the housing 37*a* therein. The housing is provided with a passageway 37*b* having a seat 37*c* which may be formed by a split ring 38. A ball or barrier 37 is positioned in the housing 37*a* on the seat 37*c* as shown and is engaged with the plunger 39 sealably positioned and threadedly engaged in the housing 37*a* and movable longitudinally thereof by rotating the member 39*a*. When the stem 39 is moved longitudinally inwardly of the housing against the ball 37, the split ring 37*c* is separated to enable the ball 37 to be discharged into the passage 37*b* for movement into the well string 16 to accommodate hanging the liner by hydraulic pressure in the well string in a manner well known in the art.

The foregoing arrangement enables circulation of well bore fluids through the top drive unit 12, manifold arrangement MA and into the well string 16 beneath the manifold arrangement after the pump down plug means has been positioned in the first connection means. More particularly, when a single pump down plug means is to be employed in a cementing operation, the manifold arrangement illustrated in FIG. 4 and in FIG. 1 will be employed. The ball valve means 61 is closed by inserting in a suitable mechanism in the noncircular opening 62c and rotating the ball valve to closed position in a well known manner. The pump down plug means may be positioned in the manifold arrangement before the first connection means are threadedly engaged with feeder 13 and well string 16, and is received on top of the closed valve means 61 as schematically illustrated at 90 in FIG. 2. Further, the valve means 67 in the second connection means associated with the first connection means of the FIG. 4 form is opened so that well bore fluids may be circulated from the drilling fluid line 20 through the swivel 24, top drive unit 12 through feeder 13 and into the upper end of the first connection means. It then bypasses around closed valve 61 through the open valve means 67 to the well string 16 therebeneath so that the fluid in the well bore may be conditioned before cementing operations are begun. If desired, the well string 16 may be rotated and reciprocated while such fluid conditioning occurs, by raising and lowering the top drive unit and also effecting rotation thereof at the same time.

When it is desired to conduct cementing operations in the well bore, cement may be discharged through the conduit 30, the feeder 13 and into the upper end of the longitudinal passage 61' of the first connection means 60. The valve 67 is closed, and valve means 61 opened so that the cement discharges downwardly against the pump down plug means and moves it down through the first connection means and well string as the cement is pumped thorugh the manifold arrangement and into the well string.

Similarly, when the manifold arrangement includes upper and lower first connection means and upper and lower spaced second connection means as diagrammatically illustrated in FIG. 2, the same operation may be performed. The ball valve means 61 and 62*a* are closed so that a pump down plug 91 can be first positioned on the lower valve means 62*a* after it has been closed, and an upper pump down plug 90 may be positioned on the valve means 61 after it has been closed. The valve means 67 in each the upper and lower spaced second connection means is opened and the well bore conditioned by circulating well bore fluid through the top drive unit 12, the feeder 13, and then through the upper and lower longitudinally spaced second connection means 64 and 69 to bypass the closed valve means 61 and 62*a* and pump down plug means supported thereon to be discharged from the well string to condition the well bore.

After the conditioning of the well bore fluids has been accomplished along with any desired rotation and reciprocation of the well string, cement may then be discharged through the inlet conduit 30 to feeder 13.

A dual plug system is employed as illustrated in FIG. 2 when it is desired to have a pump down plug means at the front end of the cement slurry and a pump down plug means at the end of the cement slurry to separate the well bore fluids from the slug of cement to prevent contamination thereof. Accordingly, in this situation the valve 67 of the lower second connection means 69 is closed while the valve 67 of the upper second connections means remains open. Also valve 61 in first connection means 60 is closed, and valve 62*a* is opened. This permits the cement to bypass through upper first connection means 60 and around the upper plug means 90 supported on the closed valve means 61 and discharge into the longitudinal passage of the lower first connection means for moving the lower pump down plug means 91 through the open valve means 62*a* (which has been opened) in the lower second connection means and into the well bore string 16 ahead of the cement.

After the desired quantity of cement has been discharged into the feeder mechanism 13, the valve means 67 in the upper second connection means 64 is closed and valve means 61 is opened so that when cement is discharged into longitudinal passage 61a of the upper first connection means it moves the upper pump down plug means 90 through the open valve means 61 and then into the well string 16 in the well bore behind the cement.

If desired, the well string may be reciprocated and rotated while the cementing operations are being conducted.

When well bore fluids are circulated to condition the well before cementing operations, the valves 61, 62*a* in the upper and lower first connection means 60 and 70, respectively, are closed and valve means 67 in upper and lower spaced connection means 60 and 70 are opened for flowing the well fluids around the plug means 90 and 91 supported on the closed valves 61 and 62*a* of the first connection means.

The foregoing manifold arrangement allows a direct line of communication for fluid flow through the top drive power unit 12 to and into the longitudinal passage of the manifold arrangement for accomplishing well bore conditioning operations either before and/or after the cement plug means employed in the cementing operation have been positioned in the manifold arrangement. Further, such arrangement is simple and eliminates some of the valving arrangement required with prior art structures. It also permits the well bore to be conditioned by circulating fluids from the inlet 20, through the top drive unit 12 and through the manifold assembly with the cement plug means in place and ready to be activated by cement supplied through the separate inlet 30. This enables the well bore fluid to be more readily conditioned independently of the cement supply inlet. Also, it enables the cement to be more readily supplied independently of the well fluid circulation inlet.

The foregoing disclosure and description of the invention are illustrative and explanatory thereof, and various changes in size, shape and materials as well as in the details of the illustrated construction may be made without departing from the spirit of hte invention.

What is claimed is:

1. A manifold arrangement for connecting between the hollow, rotatable stem extending through a top drive power unit and a well string for conducting fluid circulation and cementing operations employing cementing pump down plug means comprising:

assembly means for conducting a pumpable substance such as cement to the well string without first conducting it through the top drive power unit rotatable stem, said assembly including:

an outer tubular member;

a rotatable inner tubular member with a longitudinal passage therethrough;

said rotatable inner tubular member and longitudinal passage therethrough extending through said outer tubular member;

said rotatable inner tubular member having connection means connectable with the hollow stem for communicating the longitudinal passage in said inner tubular member with the hollow stem beneath the top drive power unit and with the well string;

said outer tubular member having lateral flow passage means to communicate with the longitudinal passage extending through said inner tubular member;

said rotatable inner tubular member having a circumferential groove on its outer surface intersecting said lateral flow passage means and said outer tubular member having a mating circumferential groove formed on its inner surface which groove means cooperate to form a continuous fluid flow passage in each said inner and outer tubular members communicating with said lateral passage means;

bearing means to accommodate rotation of said inner tubular member by the top drive power unit relative to said outer tubular member; and seal means between said rotatable inner tubular member and outer tubular member on each side of said lateral flow passage means;

first upper connection means (60) having a longitudinal passage extending therethrough with an open upper end connected with the top drive power unit rotatable stem for communicating the rotatable stem of the top drive power unit longitudinally into and through said first upper connection means;

first lower connection means (70) having a longitudinal passage extending therethrough with an open upper end connected with the lower end of said first upper connection means (6);

a valve (61) intersecting the longitudinal passage in said first upper connection means (60) and a valve (62*a*) intersecting the longitudinal passage in said first lower connection means (70);

second upper connection means (64) having passage means therethrough connected with said first upper connection means at a point above and below said valve (61) in said first upper connection means (6) for bypassing fluid flow from the top drive power unit around said valve (61) when it is closed with a cement plug means supported therein;

second lower connection means (69) having passage means therethrough connected with said first lower connection means (70) to intersect the longitudinal passage in said first lower connection means (70) at a point above and below said valve (62*a*) in said first lower connection means (70) for bypassing fluid flow from the top drive unit around said first valve (62*a*) when it is closed with a cement plug means supported therein;

a valve in the passage means formed by said second upper connection means (64) which when in open position accommodates fluid flow around said closed valve (61) in said first upper connection means (60) with the cementing plug means supported thereon and when in closed position closes flow through said second upper connection means to thereby direct flow longitudinally into said first upper connection means (60) for propelling the cementing plug means through said open valve (61) in said first upper connection means (6) and into the well string; and a valve in the passage means formed by said second lower connection means (69) which when in open position accommodates fluid flow around said closed valve (62*a*) in said first lower connection means (70) with the cementing plug means supported thereon and when in closed position closes flow through said second lower connection means (69) to thereby direct flow into said first lower connection means (70) for propelling the cementing plug means through said open valve (62*a*) in said first lower connection means (70) and into the well string.

2. The manifold arrangement of claim 1 including:

housing means;

means for connecting said housing means to said rotatable inner tubular means to communicate with the longitudinal passage therethrough;

ball means supported in said housing; and means to accommodate movement of said ball means from said housing means into the longitudinal passage of said inner rotatable tubular member.

* * * * *